US008312753B2

(12) United States Patent
Futagi et al.

(10) Patent No.: US 8,312,753 B2
(45) Date of Patent: Nov. 20, 2012

(54) METHOD OF FORMING CURLED PORTION

(75) Inventors: Tsunenari Futagi, Utsunomiya (JP); Nobuyuki Kakiya, Tochigi-ken (JP); Tadahisa Akiyama, Utsunomiya (JP); Ikuo Kato, Kumagaya (JP); Akitoshi Uchiumi, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 195 days.

(21) Appl. No.: 12/830,119

(22) Filed: Jul. 2, 2010

(65) Prior Publication Data

US 2011/0005292 A1 Jan. 13, 2011

(30) Foreign Application Priority Data

Jul. 7, 2009 (JP) ..... 2009-160918

(51) Int. Cl.
*B21D 22/00* (2006.01)
*B21D 22/21* (2006.01)

(52) U.S. Cl. ..... 72/347; 72/379.4; 72/370.11; 413/73; 413/76

(58) Field of Classification Search ..... 72/347–349, 72/379.4, 370.11; 413/73, 75, 76
See application file for complete search history.

(56) References Cited

U.S. PATENT DOCUMENTS

| | | | | |
|---|---|---|---|---|
| 1,173,793 | A * | 2/1916 | George | 72/370.03 |
| 2,864,528 | A * | 12/1958 | Henchert | 220/806 |
| 4,037,550 | A * | 7/1977 | Zofko | 413/6 |
| 4,313,545 | A * | 2/1982 | Maeda | 220/581 |
| 4,667,499 | A * | 5/1987 | Bull | 72/352 |
| 5,061,140 | A * | 10/1991 | Hamaguchi et al. | 413/6 |
| 6,782,622 | B2 * | 8/2004 | Hagiwara et al. | 29/894.362 |
| 7,171,840 | B2 * | 2/2007 | Kanou et al. | 72/379.4 |
| 7,392,683 | B2 * | 7/2008 | Luthi et al. | 72/356 |
| 2009/0022861 | A1 * | 1/2009 | Caunter et al. | 426/131 |

FOREIGN PATENT DOCUMENTS

| | | |
|---|---|---|
| JP | 09-225565 | 9/1997 |
| JP | 2005-052884 | 3/2005 |

* cited by examiner

*Primary Examiner* — Bena Miller
(74) *Attorney, Agent, or Firm* — Rankin, Hill & Clark LLP

(57) ABSTRACT

A method of forming a hollow curled portion on a hollow body, the curled portion being oriented from one end to the other end of the hollow body. The method includes a bending step of curving an end of the hollow body toward another end of the hollow body, thereby forming a curled portion, an ironing step of ironing the curled portion with a die, and a recurving step of stopping the die from ironing the curled portion and allowing the curled portion to recurve under its own resiliency in a direction opposite to the direction in which the end of the hollow body has been curved. The ironing step and the recurving step are repeated.

16 Claims, 8 Drawing Sheets

METHOD OF FORMING CURLED PORTION

CROSS-REFERENCE TO RELATED APPLICATION

This application is based upon and claims the benefit of priority from Japanese Patent Application No. 2009-160918 filed on Jul. 7, 2009, of which the contents are incorporated herein by reference.

BACKGROUND OF THE INVENTION

1. Field of the Invention

The present invention relates to a method of forming a curled portion on an end of a hollow body such as an automotive wheel rim or the like.

2. Description of the Related Art

There have widely been used in the art two-piece wheels for mounting automotive tires or the like. Such a two-piece wheel comprises a wheel rim (hereinafter simply referred to as "rim") having a substantially hollow cylindrical shape formed from a sheet material and a wheel disc (hereinafter simply referred to as "disc") having a substantially circular shape.

The rim is manufactured as follows. First, the ends of a rectangular sheet are brought into abutment against each other, producing a hollow cylindrical body. Then, the abutting ends are joined to each other by resistance welding, friction stir welding, or the like. The hollow cylindrical body is then held by a die having a certain recess. Thereafter, a spinning process is performed on the circumferential wall of the hollow cylindrical body, producing a rim having a recess called a drop defined in the circumferential wall thereof which extends in the circumferential direction.

Then, as disclosed in Japanese Laid-Open Patent Publication No. 2005-052884, the edges of the rim are curved into curled portions which make the rim stronger.

The curled portion is produced by a process shown in FIGS. 7A through 7E of the accompanying drawings. First, as shown in FIG. 7A, an edge of a rim 1 is preliminarily bent by a curling roller, not shown. The edge of the rim 1 is now curved toward the other edge thereof, producing a curled portion 2. At this time, the curled portion 2 has a substantially circular cross-sectional shape.

Then, the curled portion 2 is machined into a substantially rectangular cross-sectional shape (see FIG. 7E). An upper portion of the curled portion 2 in FIG. 7A is pressed flatwise as shown in FIG. 7B by a flattening roller, not shown.

As shown in FIG. 7C, a terminal end 3 of the curved portion 2 is compressed toward a circumferential wall 4 of the rim 1 by the curling roller.

As shown in FIG. 7D, an intermediate portion 5 of the curled portion 2 which extends substantially parallel to the circumferential wall 4 is pressed substantially flatwise by the curling roller, bringing the terminal end 3 closer to the circumferential wall 4.

Finally, a portion of the curled portion 2 near the terminal end 3 is pressed substantially flatwise by the curling roller. As shown in FIG. 7E, the curled portion 2 thus machined includes the intermediate portion 5 which extends substantially parallel to the circumferential wall 4, and a first perpendicular portion 6 and a second perpendicular portion 7 which extend substantially perpendicularly to the intermediate portion 5. The curled portion 2 is hollow and has a substantially rectangular cross-sectional shape.

The curled portion 2 is of high mechanical strength as it includes the first perpendicular portion 6 and the second perpendicular portion 7. The curled portion 2 is also excellent in appearance.

A hump, not shown, is then formed on the circumferential wall 4 of the rim 1. Thereafter, a disc having a hub hole, bolt holes, and decorative holes for better design and heat radiation is inserted into the rim 1. The rim 1 and the disc are joined to each other by MIG welding or the like, producing a wheel.

Occasionally, the curled portion 2 of the rim 1 has buckling creases 8 as shown in FIG. 8 of the accompanying drawings. The buckling creases 8 are formed because when the edge of the rim 1 is curved radially outwardly, the edge is increased in diameter, and when the curved edge, i.e., the curled portion 2, is machined into the substantially rectangular cross-sectional shape, compressive forces are applied along the circumferential directions of the curled portion 2. In other words, the buckling creases 8 are produced if the material of the curled portion 2 which is increased in diameter is not sufficiently compressed.

One solution would be to provide cuts in the edge of the rim 1 before it is curved in order that no buckling creases will be formed on the curled portion, as disclosed in Japanese Laid-Open Patent Publication No. 09-225565.

According to the invention disclosed in Japanese Laid-Open Patent Publication No. 09-225565, the workpiece which is to be provided with the curled portion is a can lid. If the disclosed invention is applied to a wheel rim, then the cuts tend to reduce the rigidity of the curled portion. Consequently, the curled portion fails to perform its primary function to increase the mechanical strength of the rim.

SUMMARY OF THE INVENTION

It is a general object of the present invention to provide a method of forming a curled portion which is excellent in appearance.

A major object of the present invention is to provide a method of forming a curled portion which is of desired mechanical strength.

According to the present invention, there is provided a method of forming a hollow curled portion on a hollow body, the curled portion being oriented from one end to the other end of the hollow body, comprising:

a bending step of curving an end of the hollow body toward another end of the hollow body, thereby forming a curled portion;

an ironing step of ironing the curled portion with a die; and a recurving step of stopping the die from ironing the curled portion and allowing the curled portion to recurve under its own resiliency in a direction opposite to a direction in which the end of the hollow body has been curved;

wherein the ironing step and the recurving step are repeated.

According to the present invention, small buckling creases produced in the bending step are made smaller when the curled portion is extended in the ironing step. Then, the curled portion is recurved in the recurving step. Therefore, the ironing step is performed intermittently. The curled portion is thus prevented from developing new buckling creases in the ironing step.

When the ironing step and the recurving step are repeated, the buckling creases are reduced to an almost invisible extent, i.e., are eliminated. The curled portion thus produced is excellent in appearance.

As described above, when the curled portion is produced, the curled portion is repeatedly ironed and recurved. The curled portion thus produced is free of buckling creases and hence is excellent in appearance.

Since there is no need to form cuts in the curled portion, the curled portion remains highly rigid and has a desired level of mechanical strength. Stated otherwise, there is produced a curled portion which is excellent in rigidity and mechanical strength. The hollow body including the curled portion is thus of increased mechanical strength.

Inasmuch as the buckling creases are made smaller when they are still small, a moving means for moving a die for ironing the curled portion in the ironing step may be of a smaller power requirement and hence may be small in size. As a consequence, an ironing apparatus that is used may be smaller in size and the facility investment may be reduced.

In addition, as the curled portion is recurved in the recurving process, a terminal end of the curled portion is prevented from being coiled into the curled portion. Therefore, the curled portion can be shaped into a desired shape.

After the curled portion is formed by pressing the one end of the hollow body in the bending step, the curled portion should preferably be further press-formed by the die used in the ironing step. Since the curled portion is thus formed stepwise, stresses required to form the curled portion are distributed stepwise. Consequently, the curled portion can be machined to a high accuracy.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

A method of forming a curled portion according to a preferred embodiment of the present invention will be described in detail below with reference to the accompanying drawings. In the preferred embodiment, a curled portion is formed on an edge of a rim (hollow body).

The method of forming a curled portion according to the present embodiment includes a bending process (step), an ironing process (step), and a recurving process (step). The bending process is carried out by a die apparatus 10 shown in FIG. 1, and the ironing process and the recurving process are carried out by a forming apparatus 12 shown in FIG. 2.

Figure 1:
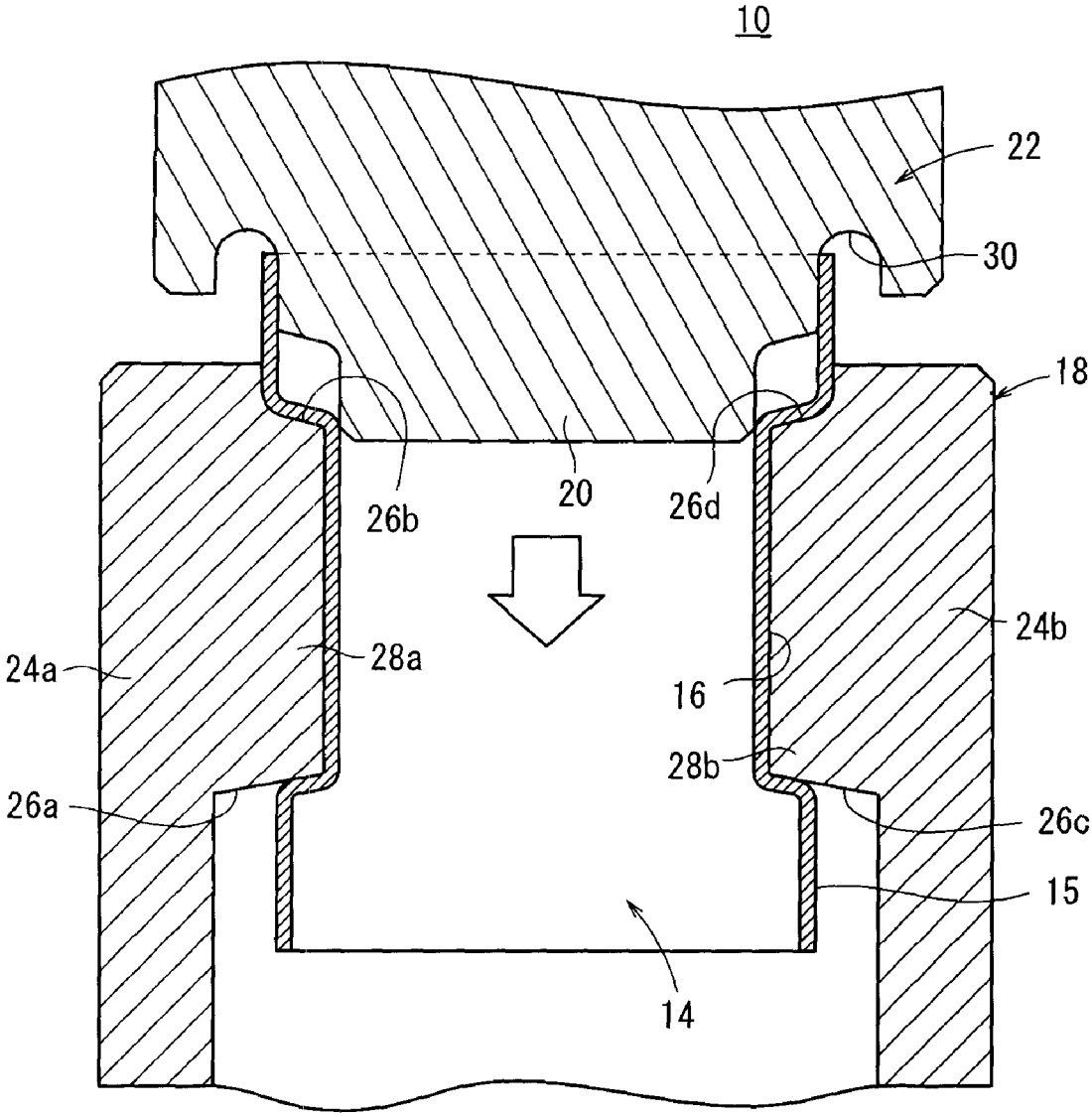
FIG. 1 is a fragmentary vertical cross-sectional view of a die apparatus for performing a bending process included in a method of forming a curled portion according to an embodiment of the present invention.

The die apparatus 10 will be described below with reference to FIG. 1. As shown in FIG. 1, a rim 14 as a workpiece to be machined has a substantially hollow cylindrical shape, and already has a drop 16 formed in a circumferential wall 15 thereof at a substantially middle region thereof in a vertical (axial) direction of the rim 14.

The die apparatus 10 comprises a fixed die 18 and a movable die 22 which are relatively movable toward and away from each other. The fixed die 18 has a circular opening defined centrally therein and having a vertical axis, the circular opening being open at the upper end of the fixed die 18. The movable die 22 has a cylindrical boss 20 projecting downwardly from the lower end thereof. The cylindrical boss 20 is insertable into the circular opening of the fixed die 18 with the rim 14 interposed therebetween. The fixed die 18 comprises two separate die members 24*a*, 24*b* including respective inner circumferential walls which have a semi-arcuate annular ledge 28*a* including respective steps 26*a*, 26*b* and a semi-arcuate annular ledge 28*b* including respective steps 26*d*, 26*c*. The annular ledges 28*a*, 28*b* engage in the drop 16 of the rim 14.

The cylindrical boss 20 of the movable die 22 faces the steps 26*b*, 26*d* of the separate die members 24*a*, 24*b*. The movable die 22 has a recess 30 defined therein around the cylindrical boss 20. The recess 30 is open toward the upper end face of the fixed die 18 and has a semi-arcuate cross-sectional shape. As described later, an upper end of the rim 14 is curved to a certain extent by the recess 30.

Figure 2:
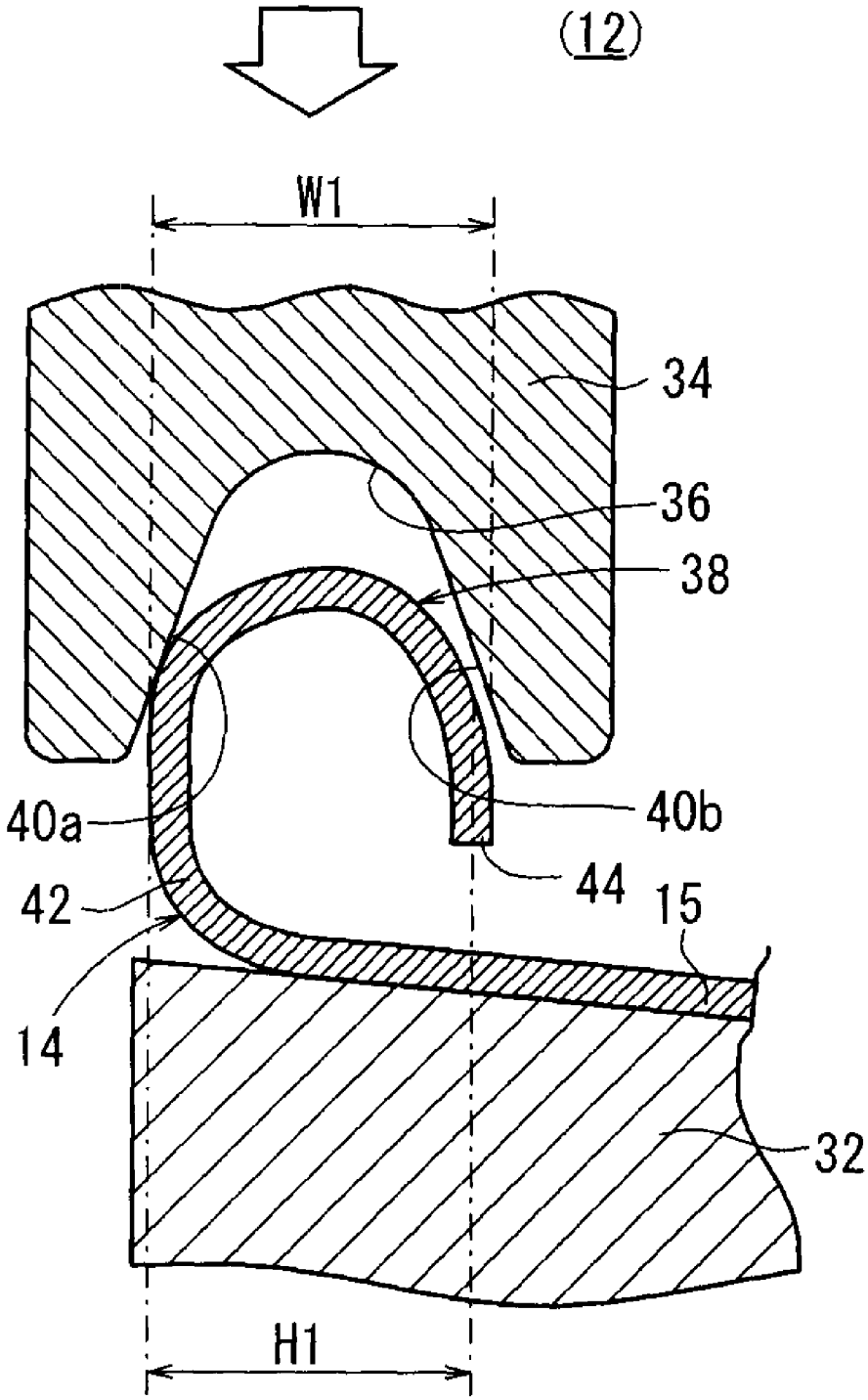
FIG. 2 is an enlarged fragmentary vertical cross-sectional view showing a manner in which a curled portion is partly flattened by a forming apparatus for performing an ironing process and a recurving process included in the method of forming a curled portion.

As shown in FIG. 2, the forming apparatus 12 includes a supporting die 32 and a forming roller (roller die) 34. The supporting die 32 is shaped complementarily to an inner wall of the rim 14, and supports the inner wall of the rim 14 when the supporting die 32 is inserted in the rim 14.

The forming roller 34 has a forming groove 36 defined in a side wall thereof around the forming roller 34. The forming groove 36 is of a substantially V-shaped cross section having side walls 40*a*, 40*b* that spread away from each other toward the open end of the forming groove 36. The forming roller 34 is rotatably supported on a support shaft, not shown. The support shaft is held by a bracket, not shown, which is movable vertically in FIG. 2 and horizontally along and perpendicularly to the sheet of FIG. 2 by hydraulic cylinders, not shown.

The method of forming a curled portion according to the present embodiment is carried out by the die apparatus 10 and the forming apparatus 12 which are basically constructed as described above, as follows.

First, as shown in FIG. 1, the drop 16 of the rim 14 is engaged by the annular ledges 28*a*, 28*b* of the fixed die 18, and a side wall of the drop 16 near the upper end of the rim 14 is supported by the steps 26*b*, 26*d* of the separate die members 24*a*, 24*b*. Now, the upper end of the rim 14 in FIG. 1 projects upwardly from the fixed die 18 toward the movable die 22.

Figure 3:
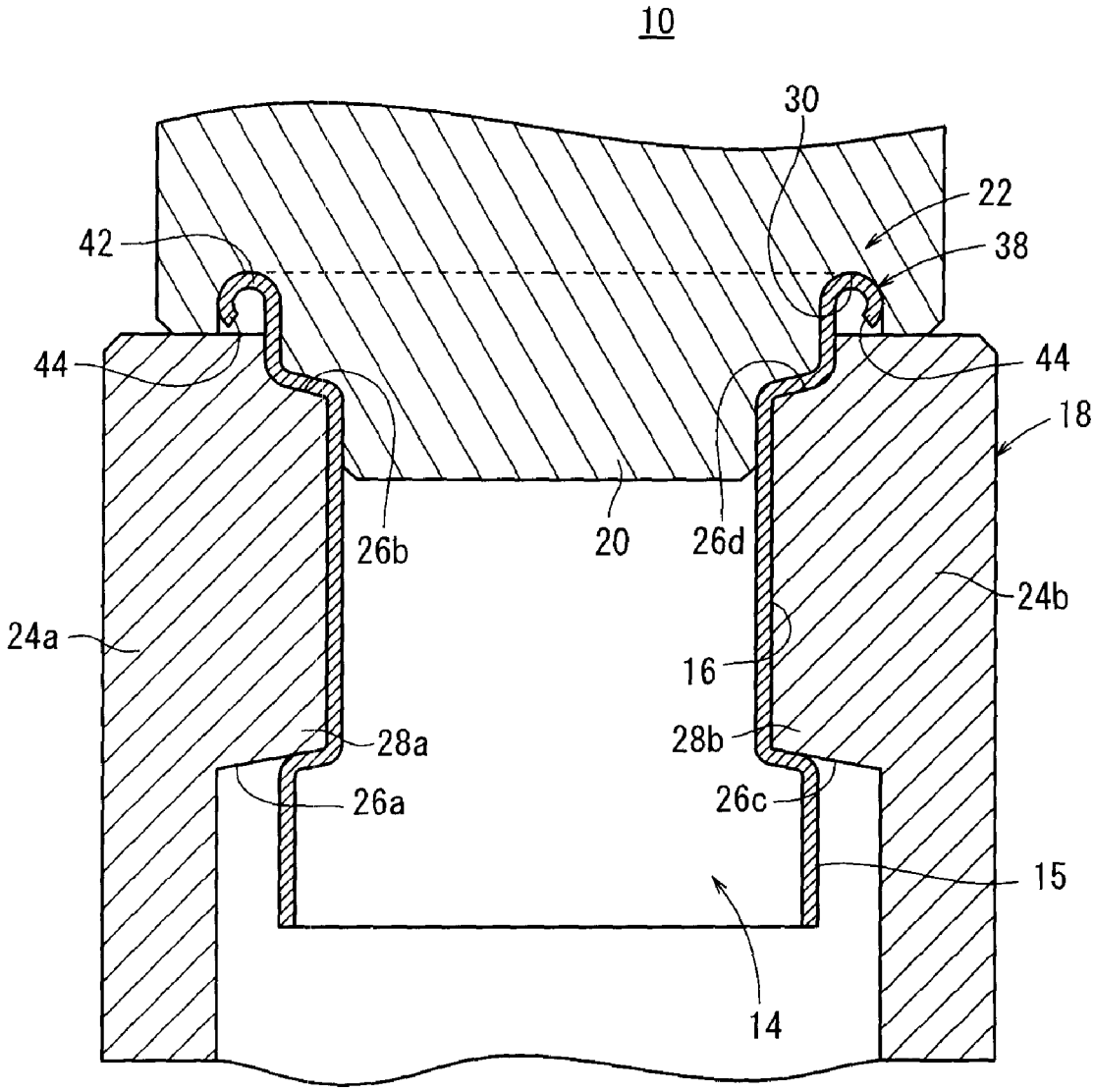
FIG. 3 is a fragmentary vertical cross-sectional view showing a manner in which the curled portion is formed by the bending process performed by the die apparatus shown in FIG. 1.

Then, as shown in FIG. 3, the movable die 22 is lowered toward the fixed die 18. As the movable die 22 descends toward the fixed die 18, the upper end of the rim 14 enters the recess 30 of the movable die 22 and is pressed into a shape complementary to the recess 30. The upper end of the rim 14 is curved to a certain extent, producing a curled portion 38, in a preliminary bending process. At this time, the lower end of the rim 14 is not formed.

Then, the movable die 22 is lifted away from the fixed die 18. The rim 14 is removed from the fixed die 18 and reversed and reset in the fixed die 18 such that the lower end of the rim 14 shown in FIGS. 1 and 3 projects upwardly from the fixed die 18 toward the movable die 22. Subsequently, the movable die 22 is lowered toward the fixed die 18 to machine the other end of the rim 14 in the same manner as described above. In this manner, the curled portions 38 are formed on the respective opposite ends of the rim 14.

The die apparatus 10 may have two movable dies 22 above and below the fixed die 18 for simultaneously forming the curled portions 38 on the upper and lower ends of the rim 14.

Figure 7A:
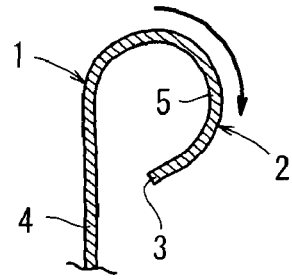
FIGS. 7A through 7E are cross-sectional views showing a sequence of forming a curled portion based on a method of forming a curled portion according to the related art.
Figure 7B:
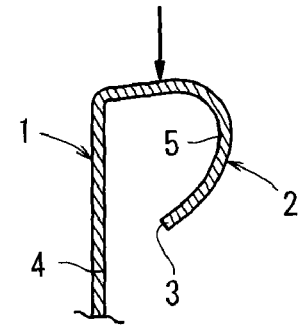
Figure 7C:
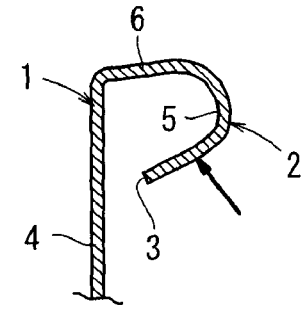
Figure 7D:
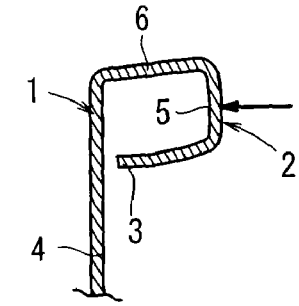

After the movable die 22 is lifted away from the fixed die 18, the rim 14 with the curled portions 38 formed on the respective opposite ends thereof is removed from the die apparatus 10. If necessary, the upper portions (left portions in FIG. 2) of the curled portions 38 may be flattened by a flattening roller, not shown, in the same manner as the step shown in FIG. 7B. In this respect, the forming roller 34 shown in FIG. 2 is unable to flatten the upper portions of the curled portions 38 because the forming groove 36 has the substantially V-shaped cross section as described above.

The rim 14 is then set in the forming apparatus 12 shown in FIG. 2, with the supporting die 32 being fitted in the rim 14 and one of the curled portions 38 being aligned with the forming roller 34.

As shown in FIG. 2, the curled portion 38 is inserted into the forming groove 36 of the forming roller 34. The hydraulic cylinders are actuated to displace the forming roller 34 toward the supporting die 32 in the direction indicated by the arrow, causing the side wall 40*a* of the forming groove 36 to press a raised end portion 42 of the curled portion 38 to a substantially flat shape. The upper portion (left portion in FIG. 2) of the curled portion 38 may have been flattened by a flattening roller, as described above.

Since the curled portion 38 is thus formed stepwise, stresses required to form the curled portion 38 are distributed stepwise. Consequently, the curled portion 38 can be machined to high accuracy.

The forming groove 36 has a width W1 slightly larger than the height H1 of the curled portion 38. As a result, the side wall 40*b* of the forming groove 36, which faces the side wall 40*a* thereof, is spaced from a terminal end 44 of the curled portion 38. When the raised end portion 42 is flattened, therefore, the terminal end 44 is not formed by the forming roller 34.

Figure 4:
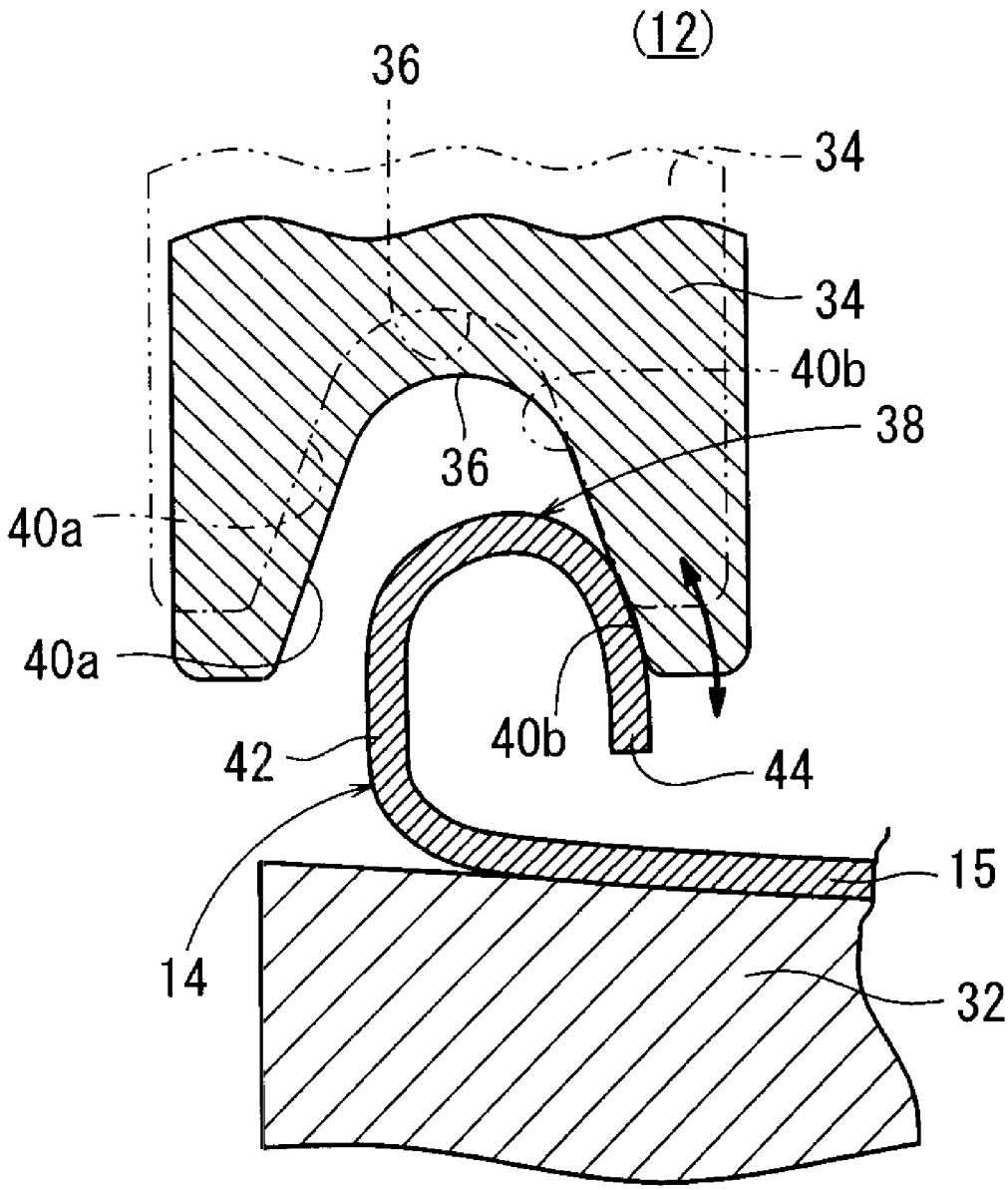
FIG. 4 is an enlarged fragmentary vertical cross-sectional view showing a manner in which the curled portion is ironed (ironing process) by the forming apparatus shown in FIG. 2.

At this time, the curled portion 38 has developed small buckling creases in the vicinity of the terminal end 44. Now, the region of the curled portion 38 in the vicinity of the terminal end 44 is machined in the ironing process and the recurving process. Specifically, as shown in FIG. 4, the forming roller 34 is positioned such that the side wall 40*b* of the forming groove 36 is held against the region of the curled portion 38 in the vicinity of the terminal end 44, and then slowly moved vertically and horizontally in FIG. 4, gradually extending the region of the curled portion 38 in the vicinity of the terminal end 44.

Since the region of the curled portion 38 in the vicinity of the terminal end 44 is ironed, i.e., extended, by the forming roller 34, the small buckling creases are also extended into smaller buckling creases. Since the buckling creases are small per se, any forces required in the ironing process to extend the buckling creases into smaller buckling creases may be small. In other words, forces required to eliminate the buckling creases may be reduced. Therefore, the hydraulic cylinders for moving the forming roller 34 may be of a smaller power requirement and hence may be small in size. As a consequence, the forming apparatus 12 may be smaller in size and the facility investment may be reduced.

According to the present embodiment, the ironing process is performed by repeatedly slightly moving the forming roller 34 while the side wall 40*b* of the forming groove 36 is being held in point-to-point contact with the region of the curled portion 38 in the vicinity of the terminal end 44, and then stopping the forming roller 34 in order to minimize the machining rate. If the ironing process is performed by continuously moving the forming roller 34 while the side wall 40*b* of the forming groove 36 is being held in face-to-face contact with the region of the curled portion 38 in the vicinity of the terminal end 44, then the machining rate of the region of the curled portion 38 in the vicinity of the terminal end 44 is too large to eliminate the buckling creases by extending the terminal end 44.

Figure 5:
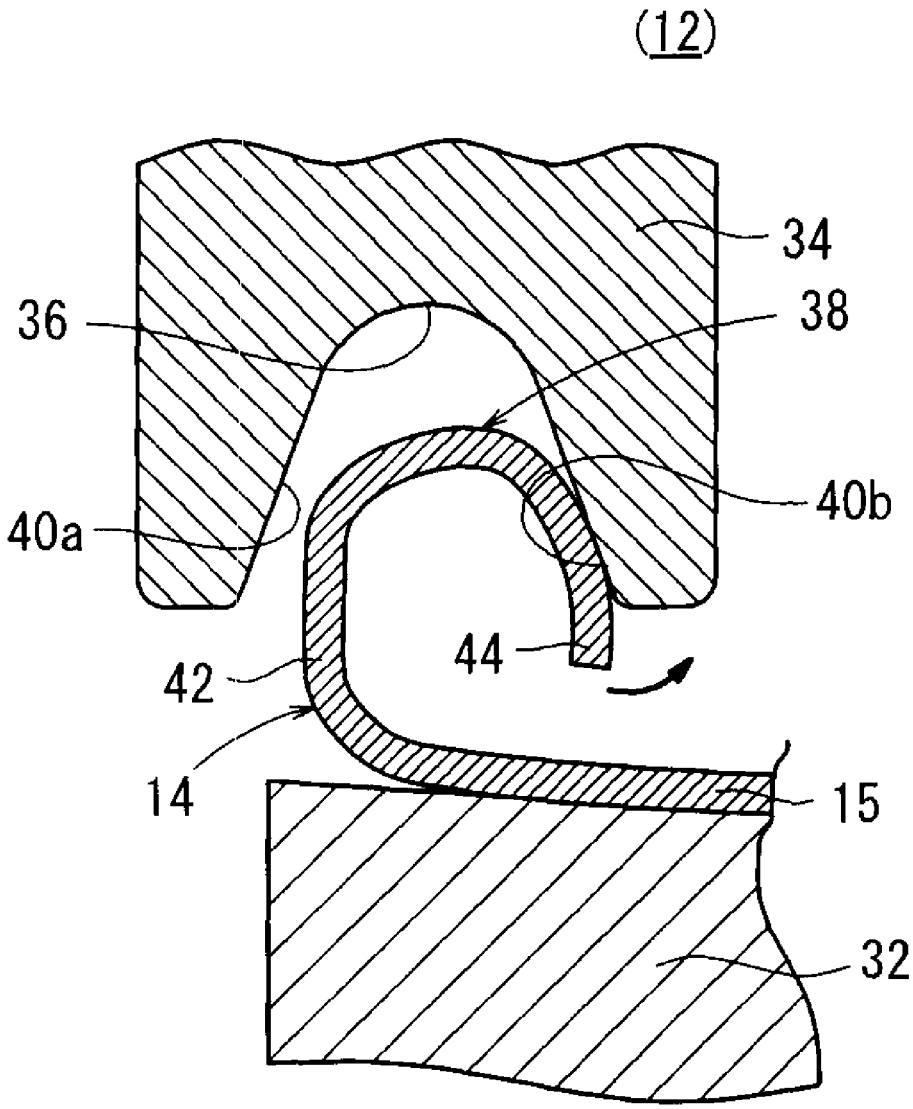
FIG. 5 is an enlarged fragmentary vertical cross-sectional view showing a manner in which the curled portion is recurved (recurving process) by the forming apparatus shown in FIG. 2.

Inasmuch as the forming roller 34 is moved vertically and horizontally, the side wall 40*b* of the forming groove 36 is repeatedly brought into contact (preferably point-to-point contact) with the region of the curled portion 38 in the vicinity of the terminal end 44 and stopped. When the forming roller 34 is stopped, the curled portion 38 is not pressed by the forming roller 34. Therefore, as shown in FIG. 5, the region of the curled portion 38 in the vicinity of the terminal end 44 is recurved under its own resiliency away from the circumferential wall 15 of the rim 14, i.e., toward the shape of its own before being curved. In this manner, the curled portion 38 is recurved.

The recurving process may be performed by spacing the side wall 40*b* of the forming groove 36 away from the region of the curled portion 38 in the vicinity of the terminal end 44. For example, the forming roller 34 may be moved into and out of contact (preferably point-to-point contact) with the region of the curled portion 38 in the vicinity of the terminal end 44.

Figure 6:
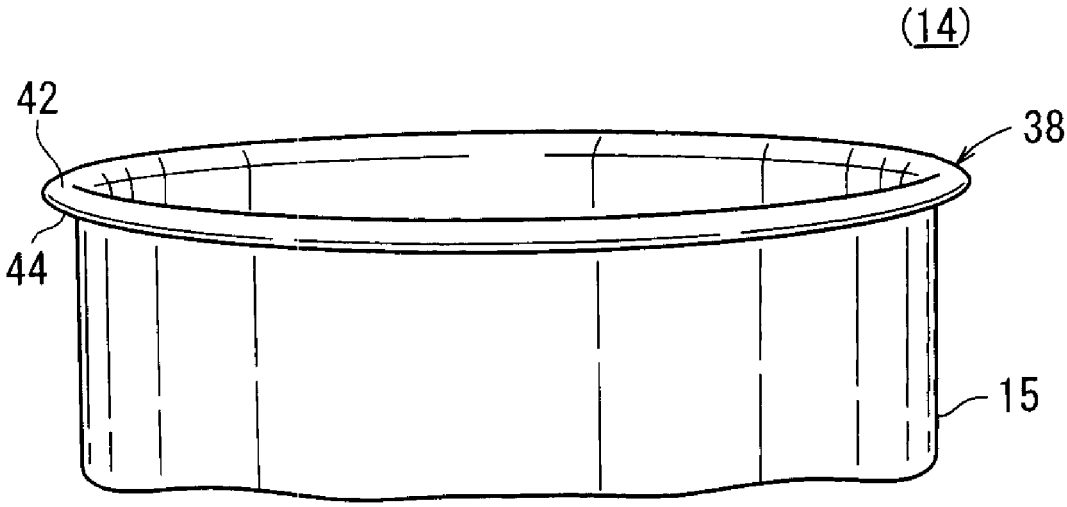
FIG. 6 is a fragmentary perspective view of a rim having a curled portion produced by the method of forming a curled portion according to the embodiment of the present invention.

When the ironing process and the recurving process described above are repeated, the small buckling creases are gradually extended and finally eliminated. By repeatedly moving the forming roller 34 circumferentially along the curled portion 38, the curled portion 38 becomes substantially free of buckling creases and excellent in appearance, as shown in FIG. 6.

Since there is no need to form cuts in the curled portion 38 unlike the related art disclosed in Japanese Laid-Open Patent Publication No. 09-225565, the curled portion 38 remains highly rigid and has a desired level of mechanical strength.

According to the present embodiment, therefore, the rim 14 has a curled portion 38 which is excellent in appearance and which is highly rigid.

In addition, as the curled portion 38 is recurved in the recurving process, the terminal end 44 is prevented from being coiled into the curled portion 38. Therefore, the curled portion 38 can have a desired rectangular cross-sectional shape. According to the present embodiment, in other words, the curled portion 38 can easily be formed to a desired shape.

Figure 7E:
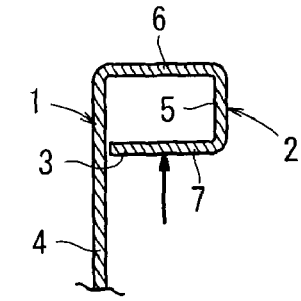
Figure 8:
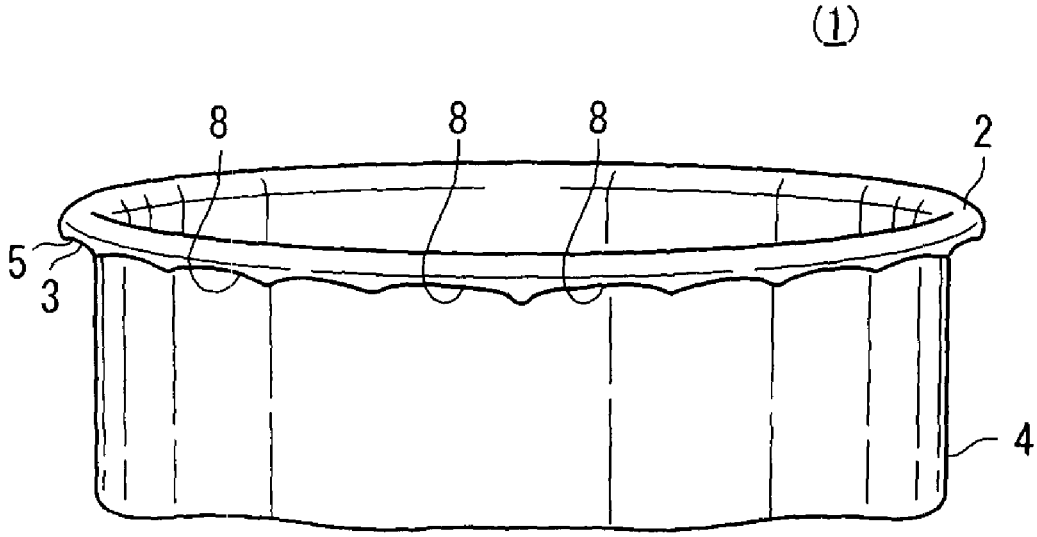
FIG. 8 is a fragmentary perspective view of a rim having a curled portion produced by the method of forming a curled portion according to the related art.

If necessary, the lower portion (right portion in FIG. 4) of the curled portion 38 may be flattened by a flattening roller, not shown, in the same manner as the step shown in FIG. 7E. The curled portion 38 whose upper portion (left portion in FIG. 4) and lower portion (right portion in FIG. 4) have thus been flattened is excellent in mechanical strength and appearance.

In the above embodiment, the single forming roller 34 is moved circumferentially along the curled portion 38 to repeat the ironing process and the recurving process. However, a plurality of forming rollers 34 may be used to perform the ironing process and the recurving process simultaneously on a plurality of locations on the curled portion 38.

The ends of the rim 14 may preliminarily be bent by a curling roller.

In the above embodiment, the curled portions 38 are formed on the rim 14. However, curled portions 38 may be formed on any hollow workpieces other than the rim 14. In other words, the principles of the present invention are not limited to a method of forming a curled portion 38 on a rim 14.

Although a certain preferred embodiment of the present invention has been shown and described in detail, it should be understood that various changes and modifications may be made therein without departing from the scope of the appended claims.

What is claimed is:

1. A method of forming a hollow curled portion on a hollow body, the curled portion being oriented from one end to the other end of the hollow body, comprising:

a bending step of curving an end of the hollow body toward another end of the hollow body, thereby forming a curled portion;

an ironing step of ironing the curled portion with a die, the ironing of the curled portion with the die extending buckling creases formed in the curled portion during the bending step; and a recurving step of stopping the die from ironing the curled portion and allowing the curled portion to recurve under its own resiliency in a direction opposite to a direction in which the end of the hollow body has been curved;

wherein the ironing step and the recurving step are repeated.

2. The method according to claim 1, wherein after the curled portion is formed by curving the one end of the hollow body in the bending step, the curled portion is further pressed by the die used in the ironing step.

3. The method according to claim 2, wherein the die used in the ironing step comprises a roller die having a forming groove defined in a side wall thereof for insertion of the curled portion therein.

4. The method according to claim 3, wherein the ironing step is carried out while a side wall of the forming groove of the roller die is being held in point-to-point contact with the curled portion.

5. The method according to claim 1, wherein the ironing step is carried out by moving the die, and the ironing step is stopped by stopping the die.

6. The method according to claim 1, wherein the ironing step is carried out by moving the die, and the ironing step is stopped by spacing the die away from the curled portion.

7. The method according to claim 1, further comprising:

a flattening step of flattening a portion of the curled portion formed by the bending step;

wherein the ironing step and the recurving step are repeated after the flattening step.

8. The method according to claim 1, wherein the hollow body comprises a wheel rim of a wheel on which a tire is to be mounted.

9. The method according to claim 1, wherein buckling creases are formed in the curled portion during the bending step, and the ironing step is performed after the bending step.

10. The method according to claim 1, wherein during the ironing step, the buckling creases are extended toward a terminal end of the curled portion.

11. The method according to claim 1, wherein the recurving step includes stopping the ironing step by stopping the die from ironing the curled portion such that the curled portion recurves under its own resiliency in a direction opposite to a direction in which the end of the hollow body has been curved.

12. The method according to claim 11, wherein the ironing step is stopped during the recurving step by moving the die away from the curled portion such that the die is spaced from the curled portion.

13. The method according to claim 11, further comprising:

after the bending step and prior to the ironing step and the recurving step, a flattening step of flattening a portion of the curled portion formed by the bending step.

14. The method according to claim 11, wherein after the curled portion is formed by curving the one end of the hollow body in the bending step, the curled portion is further pressed by the die used in the ironing step, the die used in the ironing step comprises a roller die having a forming groove defined in a side wall thereof for insertion of the curled portion therein, and the ironing step includes inserting the curled portion into the forming groove of the roller die and moving the roller die in a horizontal and vertical direction relative to the curved portion so as to extend a part of the curved portion in a vicinity of a terminal end of the curved portion.

15. The method according to claim 14, wherein the ironing step is stopped during the recurving step by moving the roller die away from the curled portion such that the roller die is spaced from the curled portion.

16. The method according to claim 14, wherein the terminal end of the curved portion is a terminal end of the hollow body.

* * * * *